US009122195B2

(12) United States Patent
Furukawa

(10) Patent No.: US 9,122,195 B2
(45) Date of Patent: Sep. 1, 2015

(54) IMAGE FORMING APPARATUS

(71) Applicant: CANON KABUSHIKI KAISHA, Tokyo (JP)

(72) Inventor: Mitsuhiro Furukawa, Kawaguchi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/524,015

(22) Filed: Oct. 27, 2014

(65) Prior Publication Data

US 2015/0139700 A1 May 21, 2015

(30) Foreign Application Priority Data

Nov. 21, 2013 (JP) ..... 2013-240583
Dec. 12, 2013 (JP) ..... 2013-256862

(51) Int. Cl.
*G03G 15/09* (2006.01)
*G03G 15/08* (2006.01)

(52) U.S. Cl.
CPC ..... *G03G 15/0812* (2013.01); *G03G 15/09* (2013.01)

(58) Field of Classification Search
CPC ..... G03G 15/0812; G03G 15/09
USPC ..... 399/274, 284
See application file for complete search history.

(56) References Cited

U.S. PATENT DOCUMENTS 7,269,382 B2 9/2007 Hashimoto
7,729,646 B2 6/2010 Fujiwara et al.
7,773,922 B2 * 8/2010 Nishino et al. ..... 399/274
2005/0047832 A1 3/2005 Hashimoto
2009/0097887 A1 4/2009 Fujiwara et al.

FOREIGN PATENT DOCUMENTS

JP 11-231645 A 8/1999
JP 2005-070497 A 3/2005
JP 2009-093072 A 4/2009
JP 2009-093073 A 4/2009
JP 2010-243963 A 10/2010
JP 5100297 B2 12/2012
JP 2013-140273 A 7/2013
JP 5300567 B2 9/2013
JP 5441330 B2 3/2014

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes an image bearing member where an electrostatic latent image is formed, a developing device developing the electrostatic latent image at a developing position facing the image bearing member, the developing device including a developer bearing member which rotates while bearing developer containing toner and which supplies the image bearing member with the toner, and a regulating member regulating a layer thickness of the developer born by the developer bearing member. In addition, a vibrating member vibrates the regulating member when the vibrating member is driven, and a control unit performs a mode of vibrating the regulating member while rotating the developer bearing member during a non-image forming period and of transferring from the developer bearing member to the image bearing member the toner passing through the regulating member during vibration of the regulating member.

7 Claims, 14 Drawing Sheets

FIG. 5

| | VIBRATION | DISCHARGING DURING VIBRATION | VIBRATION TIMING | AGGLOMERATION MARK | STRIPE SHAPE OF LOW DENSITY | DEGREE OF AGGLOMERATION |
|---|---|---|---|---|---|---|
| EMBODYING EXAMPLE 1—1 | PRESENT | PRESENT | MODE 1 | ○ | △ | 65 |
| EMBODYING EXAMPLE 1—2 | PRESENT | PRESENT | MODE 2 | ○ | ○ | 60 |
| EMBODYING EXAMPLE 1—3 | PRESENT | PRESENT | MODE 3 | ○ | ○ | 58 |
| COMPARATIVE EXAMPLE | ABSENT | ABSENT | — | × | × | 70 |
| CONVENTIONAL EXMAPLE | PRESENT | ABSENT | — | × | △ | 71 |

FIG. 10

| | NORMAL CONDITION FOR VIBRATION | CONDITION FOR VIBRATION WITH LOW IMAGE RATE | | | | RELATION WITH DISCHARGING |
|---|---|---|---|---|---|---|
| | | 1%Duty OR LESS | 1 ~ 2%Duty | 2 ~ 5%Duty | 5%Duty OR MORE | |
| EMBODYING EXAMPLE1 | EVERY 1000 SHEETS | – | – | – | – | IN CONJUNCTION WITH DISCHARGING |
| EMBODYING EXAMPLE2 | – | EVERY 1000 SHEETS | EVERY 4000 SHEETS | EVERY 1000 SHEETS | NOTHING | IN CONJUNCTION WITH DISCHARGING |
| EMBODYING EXAMPLE3 | AT LOW DUTY DISCHARGING | – | – | – | – | IN CONJUNCTION WITH DISCHARGING |
| EMBODYING EXAMPLE4 | AT LOW DUTY DISCHARGING | EVERY 1000 SHEETS | EVERY 4000 SHEETS | EVERY 1000 SHEETS | NOTHING | IN CONJUNCTION WITH DISCHARGING |
| EMBODYING EXAMPLE5 | EVERY 1000 SHEETS | EVERY 1000 SHEETS | EVERY 4000 SHEETS | EVERY 1000 SHEETS | NOTHING | IN CONJUNCTION WITH DISCHARGING ONLY AT LOW IMAGE RATE |

IMAGE FORMING APPARATUS

BACKGROUND OF THE INVENTION

1. Field of the Invention

The present invention relates to an image forming apparatus for forming an image by an electrophotographic method or by an electrostatic recording method.

2. Description of the Related Art

As an image forming apparatus for forming an image by an electrophotographic method or by an electrostatic recording method, conventionally an image forming apparatus with a developing sleeve is often employed. In these methods, an electrostatic latent image formed on an image bearing member is developed using one-component developer or two-component developer In general, the developing sleeve is rotatably supported on an opening of a developing device by bearings at both ends. In order that the developer is easily carried on the developing sleeve, the surface of the developing sleeve may be subjected to a roughening treatment or grooves may be provided on the surface of the developing sleeve.

When an amount of developer in the developing sleeve surface is not uniform, there is a possibility that a density of an image visualized on the photosensitive member becomes uneven. Therefore, it is desirable to make uniform an amount of developer on the developing sleeve surface. As a countermeasure of this problem, a regulating member, called "regulating blade" is generally used to uniformly regulate an amount of developer on the developing sleeve surface.

The developing device includes a developing container for containing developer, where a conveying member such as a screw or the like is generally disposed. The developer is circulated and conveyed in the developing container by the conveying member.

By the way, the phenomena may occur in the developing device, that a foreign matter is pinched between the regulating blade and the developing sleeve, agglomerates are coated as a toner layer grows due to deterioration of the developer, or agglomerates are clogged. In these cases, coated agglomerates are developed and thereby agglomeration marks appear or concentration of the developer becomes lower due to the fact that the coat of the developer becomes thinner in a region where the agglomerates are caught.

For this problem, in Japanese Patent Laid Open Publication No. H11-231645, a method of removing a caught foreign matter is proposed, wherein the regulating blade is moved to release it spatially. However, in this method, because the regulating blade is moved to release it spatially, the coating amount becomes more as compared with the normal period and thus it is difficult to perform this method during image forming operation. Also, if this method is carried out in a non-image formation period, the time period in which image formation is not performed becomes longer.

Therefore, in Japanese Patent Laid Open No. 2009-93073, a method of vibrating a layer thickness regulating blade during non-image formation period such as a post-rotation period after image formation and an inter-sheet interruption during image formation is proposed. This prevents image defects by minimizing downtime of the image formation and by avoiding growth of a toner layer.

However, in the method of vibrating a layer thickness regulating blade during non-image formation such as a post-rotation period after image formation and an inter-sheet interrupt during image formation as in the Japanese Patent Laid Open No. 2009-93073, toner agglomerates which come out by vibrating the regulating blade are leveled and return to the developing device. Since the toner agglomerates are degraded, if they return to the developing device, it may cause reduction of fluidity and degradation in development property.

The Japanese Patent Laid Open No. 2013-140273 discloses that the toner replacement control is performed, wherein when fluidity of the developer is reduced, an electrostatic latent image of 20% of image ratio in the post-rotation period and the electrostatic latent image is developed by the developing device and deteriorated toner is discharged. Furthermore, the Japanese Patent Laid Open No. 2013-140273 discloses a structure for recovering a stagnating state of the developer in the developer reservoir by vibrating a layer thickness regulating blade with a vibrator. It also discloses that the toner replacement control can be performed in parallel to blade vibration.

However, in the Japanese Patent Laid Open No. 2013-140273, the position to be vibrated by a blade is different from the position where the deteriorated toner is actually discharged to the photosensitive drum. Therefore, when the blade vibration is performed in parallel to the discharging operation, the toner having passed through the blade during vibration is not always discharged on a photosensitive drum. Therefore, there is a possibility that the deteriorated toner agglomerates passing through the blade during the blade vibration is collected in the developing device again without being discharged on the photosensitive drum.

Therefore, an object of the present invention is to suppress defects caused by the fact that the deteriorated toner agglomerates having passed through the regulating member are collected in the developing device when executing a mode for vibrating the toner agglomerates by driving the developer bearing member during a non-image formation period.

SUMMARY OF THE INVENTION

Therefore, the present invention provides an image forming apparatus, comprising: an image bearing member on which an electrostatic latent image is formed; a developing device which develops the electrostatic latent image at a developing position facing the image bearing member, the developing device including a developer bearing member which rotates while bearing developer containing toner and which supplies the image bearing member with the toner; a regulating member which regulates a layer thickness of the developer born by the developer bearing member; and a vibrating member which vibrates the regulating member when the vibrating member is driven; and a control unit that performs a mode of vibrating the regulating member while rotating the developer bearing member during a non-image forming period and of transferring from the developer bearing member to the image bearing member the toner which passes through the regulating member during vibration of the regulating member.

Further features of the present invention will become apparent from the following description of exemplary embodiments with reference to the attached drawings.

BRIEF DESCRIPTION OF THE DRAWINGS

FIG. 5 is a table showing study results with various conditions of embodying examples, comparative examples and a conventional example of the first embodiment.

FIG. 10 is a table showing study results with various conditions of embodying examples of the second embodiment.

DESCRIPTION OF THE EMBODIMENTS

Embodiments of a developing device and an image forming apparatus according to the present invention will be explained with reference to the accompanying drawings. By way of an example, an image forming apparatus and a developing device according to the following structure are shown, but the present invention is not necessarily limited to the following embodiments. The present invention can be applied to an image forming apparatus according to any of the tandem type, 1-drum type, the intermediate transfer type, or the direct transfer type. Furthermore, the present invention can be also applied to a developing device using two-component developer or one-component developer.

In this embodiment, only the main unit according to formation of a toner image will be explained. However, the present invention is not limited thereto and the present invention can be implemented in various applications such as various types of printing machines, copiers, FAX and MFP with additional necessary equipment and housing structure.

[First Embodiment]

Figure 1:
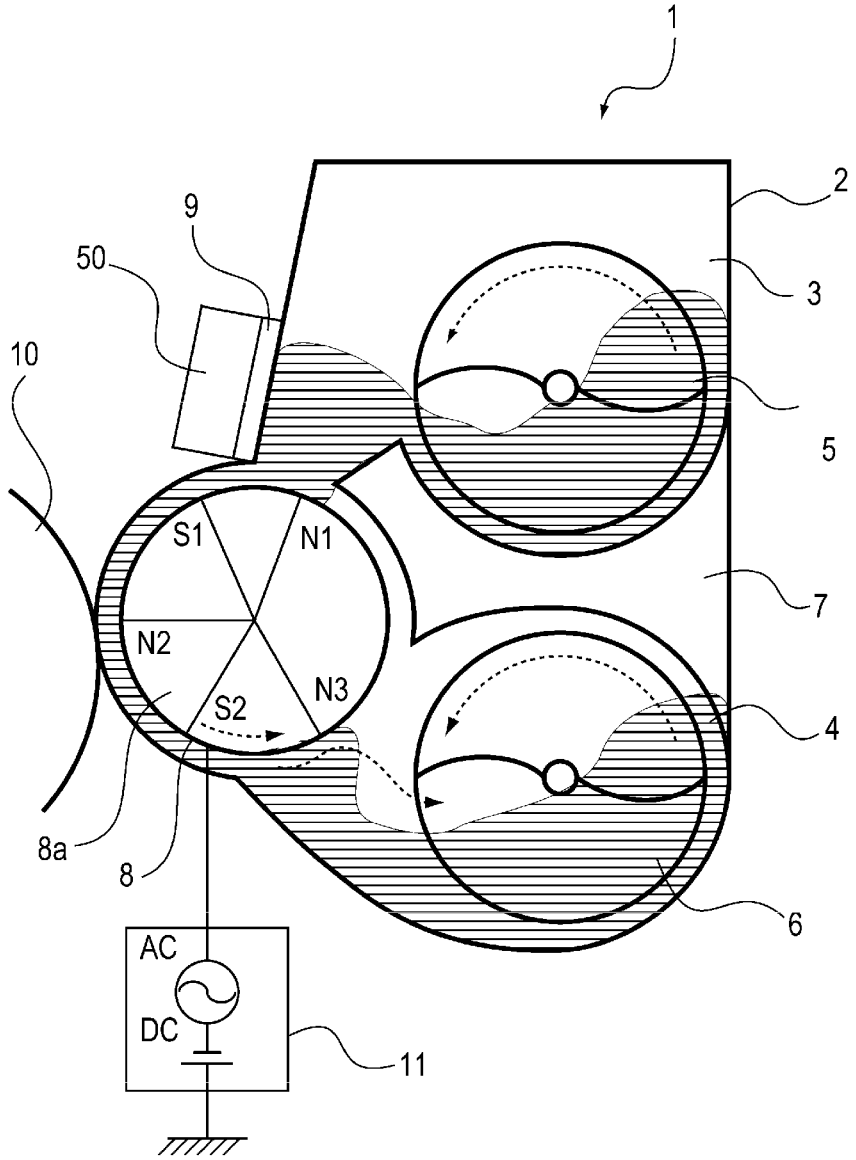
FIG. 1 is a cross sectional view of a developing device.
Figure 2:
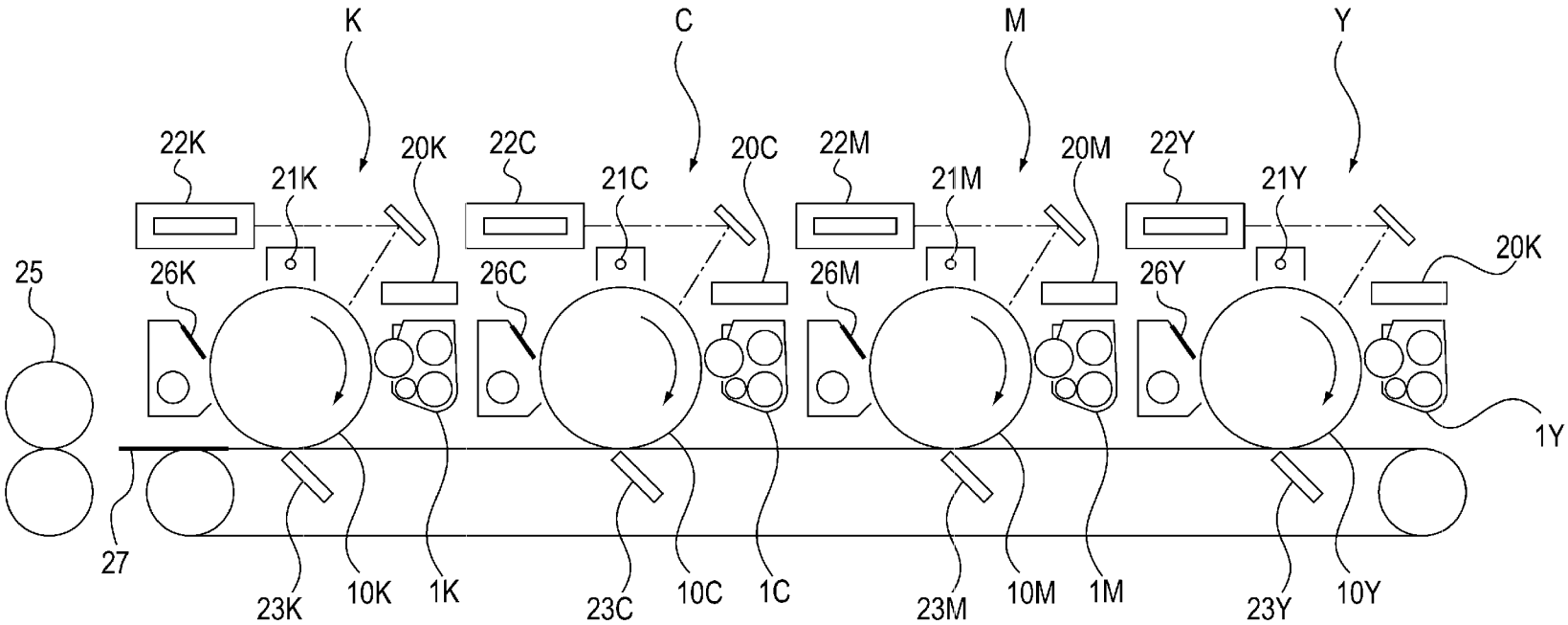
FIG. 2 is a schematic diagram of an image forming apparatus.

FIG. 1 is a sectional view of the developing device. FIG. 2 is a schematic diagram of an image forming apparatus. In the image forming apparatus, each of the stations Y, M, C, and K is substantially the same structure. Then, an image of the color yellow (Y), magenta (M), cyan (C) and black (K) out of the full color image is formed in each station, respectively. In the following description, for example, the description of "developing device 1" is intended to generally refer to the developing devices 1Y, 1M, 1C and 1K at stations Y, M, C, and K.

<Image forming apparatus> FIG. 1 is a diagram showing positional relationship between the photosensitive drum 10 (image bearing member) and the developing device 1 (developing unit) in FIG. 2. As described below, the photosensitive drum 10 is disposed in each station Y, M, C, and K of a full-color image forming apparatus.

As shown in FIG. 2, the photosensitive drum 10 is rotatably mounted on the main body of the image forming apparatus. During the image forming operation, the photosensitive drum 10 is uniformly charged by the primary charger 21. Then the light such as laser is emitted by the light emitting element in the exposure unit 22 to expose the photosensitive drum 10. Here, since the light is modulated in accordance with image information signal, an electrostatic latent image is formed on the photosensitive drum 10.

The electrostatic latent image is visualized as a developer image (toner image) by the developing device 1 through the process described below. The toner image is transferred onto the transfer material 27 on the transfer material carrying sheet 24 which is arranged to face the photosensitive drums 10. Upon transfer of the toner images to the transfer material 27, the toner image is attracted by the transfer bias of the first transfer charger 23 disposed on the opposite side of the photosensitive drum 10 via the transfer material conveying sheet 24.

Each color toner image is transferred so as to overlap the transfer material 27 and then is fixed to the transfer material 27 by the fixing device 25. Thereby a permanent image is formed on the transfer material 27.

Transfer residual toner remaining on the photosensitive drum 10 is removed by the cleaning device 26. Toner is replenished from the toner supply tank 20 in the quantity of the toner in the developer which is consumed during the image formation operation. Process speed of the image forming apparatus of this embodiment is 300 mm/s.

Employed in this embodiment is the method of transferring the toner directly to the transfer material 27 which is conveyed from the photosensitive drum 10 to the transfer material conveying sheet 24, but the invention is not limited thereto. For example, an intermediate transfer member can be used in place of the transfer material conveying sheet 24. With this structure, a toner image of each color can be primarily transferred from the photosensitive drum 10 of each color to the intermediate transfer member and thereafter composite toner image can be collectively secondarily transferred on the transfer material.

<Two-component developer> Next, two-component developer used in this embodiment is explained.

The toner includes binder resin, colorant, colored resin particles containing other additives as required and colored particles to which the external additive such as colloidal silica fine powder is externally added. As the toner particles of this embodiment, pulverized toner containing 1-20 wt % of a wax component is used to achieve the oil-less fixing. The toner is of polyester resin of the negative charge, and the volume average particle diameter of the toner is 7.0 μm in this embodiment.

As a carrier, metals such as iron surface oxidized or non-oxidized, nickel, cobalt, manganese, chromium and rare earth, and alloys thereof or oxide ferrite can be preferably used for example. The preparation of these magnetic particles is not particularly limited.

<Developing device> Next, the detailed configuration of the developing device 1 and the operation is explained by referring to FIG. 1.

The developing device 1 houses the developer in the developing container 2. The developer to be housed is two-component developer containing non-magnetic toner and magnetic carrier. The developing sleeve 8 (developer bearing member) is disposed in the developing container 2. The toner transfer is performed to the photosensitive drum 10 by the developing sleeve 8. A layer thickness of the developer born on the developing sleeve 8 is regulated by the regulating blade 9 (regulating member) which is arranged so as to face to the developing sleeve 8.

As shown in FIG. 1, at the substantially central portion of the developing container 2, the partition wall 7 extends parallel to the longitudinal direction of the developing sleeve 8. The partition wall 7 is partitioned up and down inside of the developing container 2. The developing chamber 3 is formed above and the stirring chamber 4 is formed below in the developing container 2. The stirring chamber 4 and the developing chamber 3 house the developer.

As a means for stirring and conveying the developer in the developing container 2, the first conveying screw 5 is disposed in the developing chamber 3, and the second conveying screw 6 is disposed in the stirring chamber 4.

The first conveying screw 5 is disposed substantially in parallel and along the axial direction of the developing sleeve 8 at the bottom of the developing chamber 3. The first conveying screw 5 is rotated to convey the developer in the developing chamber 3 in one direction along the axial direction. The second conveying screw 6 is disposed substantially in parallel to the first conveying screw 5 at the bottom of the stirring chamber 4. The second conveying screw 6 conveys the developer of the stirring chamber 4 in the opposite direction of the conveying direction of the first conveying screw 5. Thus, the developer in the developing container 2 is conveyed by the first conveying screw 5 and the second conveying screw 6.

Also, openings (communicating portion) for communicating the stirring chamber 4 with the developing chamber 3 are formed at both ends of the partition wall 7. Through the openings of the partition wall 7, the developer is circulated between the stirring chamber 4 and the developing chamber 3. The developer in the developing chamber 3 is conveyed by the first conveying screw 5 and is supplied to the developing sleeve 8 through the gap between the partition wall 7 and the regulating blade 9.

The first conveying screw 5 and the second conveying screw 6 have a screw structure where impellers of nonmagnetic material are provided spirally around the rotation axis. The diameter of each screw is ϕ20 mm and the screw pitch is 30 mm. The rotational speed of the impellers is set to 600 rpm.

The developing container 2 has an opening at a position corresponding to the developing region (developing position) where the photosensitive drum 10 is opposed to the developing sleeve 8. The developing sleeve 8 is provided at the opening such that the developing sleeve 8 is partially exposed from the developing container 2. The gap (SD gap) between the developing sleeve 8 and the photosensitive drum 10 is about 250 μm.

The developing sleeve 8 is made from a non-magnetic material and the magnetic roller 8a (magnetic field generating means) is installed in a non-rotating state therein. The magnet roller 8*a* has the developing pole S2 and the poles S1, N1, N2, N3 for conveying the developer. The poles N1 and N3 of a same polarity are provided to be adjacent to each other in the inner side of the developing container 2. A repulsive magnetic field is formed between the poles N1 and N3. Therefore, the developer is separated from the surface of the developing sleeve 8 in the stirring chamber 4.

When developing the electrostatic latent image on the photosensitive drum 10, the developing sleeve 8 is rotated in the arrow direction in FIG. 1. A layer thickness of the two-component developer carried on the developing sleeve 8 is regulated by the magnetic brush caused by the regulating blade 9. The developer of which layer thickness is regulated is conveyed to the developing region facing the photosensitive drum 10. Then, with the developer, the electrostatic latent image formed on the photosensitive drum 10 is developed.

The regulating blade 9 is made of a non-magnetic member such as an aluminum plate which is extended along the longitudinal axis of the developing sleeve 8. The regulating blade 9 is disposed on the upstream side of the photosensitive drum 10 in the rotation direction of the developing sleeve 8.

As described above, the toner and the carrier of the developer are supplied to the developing region through the gap between the end portion of the regulating blade 9 and the surface of the developing sleeve 8. Therefore, by adjusting the gap, a bristle cutting amount of the magnetic brush (in which developer is napped in a brush shape by the magnetic) of the developer carried on the developing sleeve 8 is adjusted and a layer thickness of the developer is regulated accordingly.

In the present embodiment, a developer coating amount per unit area of the developing sleeve 8 is regulated to 30 mg/cm$^2$ by regulating blade 9. In addition, the peripheral speed ratio V of the developing sleeve 8 for the photosensitive drum 10 is set to 175%.

A developing bias used in this embodiment is applied by the developing bias application unit 11. The developing bias to be applied to the developing sleeve 8 is obtained by superimposing a DC component and an AC component.

In this embodiment, the blank pulse of the DC component in which an alternating-current component is thinned out intermittently is provided. The AC component is the square wave of 10 kHz and the blank portion has 8 pulses when a half cycle of the rectangular wave is made to one pulse. The ratio (Duty) of the development-side electric field to the recovery side electric field is 50%.

<Vibration member> The vibrating member 50 for vibrating the regulating blade 9 will be explained.

As shown in FIG. 1, the vibrating member 50 is provided in contact with the regulating blade 9. The vibration member 50 includes a motor and is vibrated by rotating the motor, thereby the regulating blade 9 disposed in contact with the vibration member 50 is vibrated.

Figure 3:
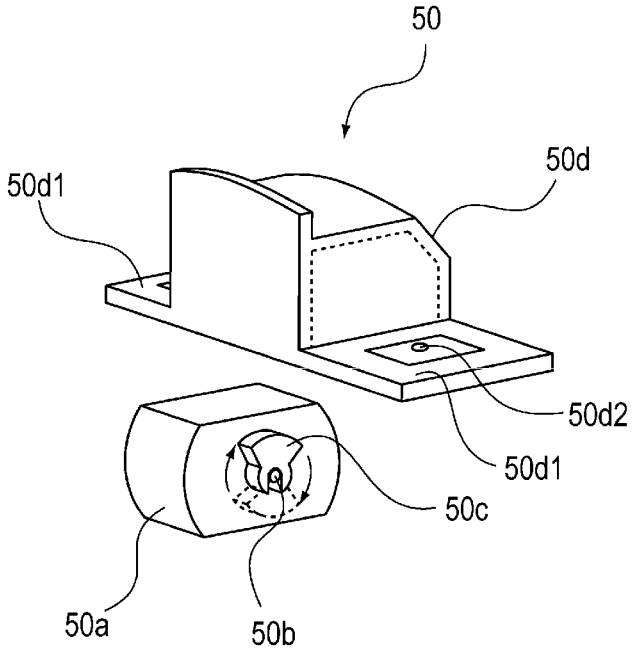
FIG. 3 is a diagram showing a configuration of a vibrating member.

FIG. 3 is a diagram showing the configuration of the vibration member.

As shown in FIG. 3, the vibrating member 50 includes the motor 50*a*, the weight 50*c* attached to the output shaft 50*b* and the case 50*d*. The case 50*d* includes the mounting portion 50*d*1 for attaching the vibrating member 50 to the regulating blade 9. The vibrating member 50 is fixed to the regulating blade 9 by a fixing member such as a screw, using the mounting hole 50*d*2 provided in the mounting portion 50*d*1.

The rotation speed of the motor 50*a* is 8000 rpm. The weight 50*c* fixed with the center of gravity is biased to one side with respect to the output shaft 50*b*. The output shaft 50*b* of the motor 50*a* is driven to rotate by a control signal from the control circuit thereby the motor 50*a* is vibrated. This vibration is propagated to the case 50*d* and the regulating blade 9.

The case 50*d* includes the function to prevent toner from entering into the motor 50*a* and the function that makes the vibration to efficiently propagate to the regulating blade 9 by restraining the motor 50*a*.

The vibration member 50 is not limited to the above configuration as long as the configuration supplies enough vibration for removing toner agglomerates with the regulating blade 9.

<Mechanism of toner agglomeration> Hereinafter, the mechanism will be explained, in which toner agglomerates occur. When the image ratio of the output is low, the external additive of the toner is embedded or freed and thereby a degree of the agglomeration increases. It is known that when a degree of the agglomeration of the toner increases, the toner agglomerates are easy to occur.

Generally, at the back side of the regulating blade, the toner near the developing sleeve is conveyed fast and the toner away from the developing sleeve is slowly conveyed or does not move. Thus, in the boundary region between developer of slow conveying speed and developer of fast conveying speed, a shear surface associated with the conveying speed difference generates. At this position, the toner deteriorates and when the freed toner accumulates, agglomerates are formed.

In particular, the pulverized toner containing a wax component, for example, can be manufactured relatively inexpensively compared to the polymerized toner, but the wax component tends to be present in the toner near the surface from the production process. When the external additive of the toner is embedded or freed, there is a tendency that the friction coefficient between toner particles becomes higher due to the effect of the wax component of the toner surface. As a result, there is a tendency for a degree of agglomeration of the toner to become high and toner particles are liable to stick to each other.

At the place where the toner agglomerates are grown in developer, coating on the developing sleeve is inhibited more than as compared with other places, thereby the coating amount of the developer is reduced. Thus, only that part becomes thin density as the image. Further, when the toner agglomerates are grown and they are clogged between the regulating blade and the developing sleeve, an image with a stripe shaped loss may occur.

<Method of measuring a degree of agglomeration> At the powder properties measuring instrument, sieves are set by overlapping them in three-stage in the order of 60 mesh, 100 mesh and 200 mesh from above. Then, 5 g of sample which is weighed is placed on the top of the sieves gently and 15 seconds of vibration at the voltage of 17V is given. And then, the weight of the toner remaining on each sieve is measured. After that, a degree of the agglomeration is calculated according to the formula shown below.

In the calculation, MT denotes an amount of toner on the upper mesh, MC denotes an amount of toner on the middle mesh and MB denotes an amount of toner on the lower mesh.

A degree of agglomeration is shown as below.

Degree of agglomeration (%)=X+Y+Z, where $$X=MT/5\times100,$$

$$Y=MC/5\times100\times0.6,$$

$$Z=MB/5\times100\times0.2.$$

A degree of aggregation of toner used in this embodiment was measured as 40%.

Figure 4:
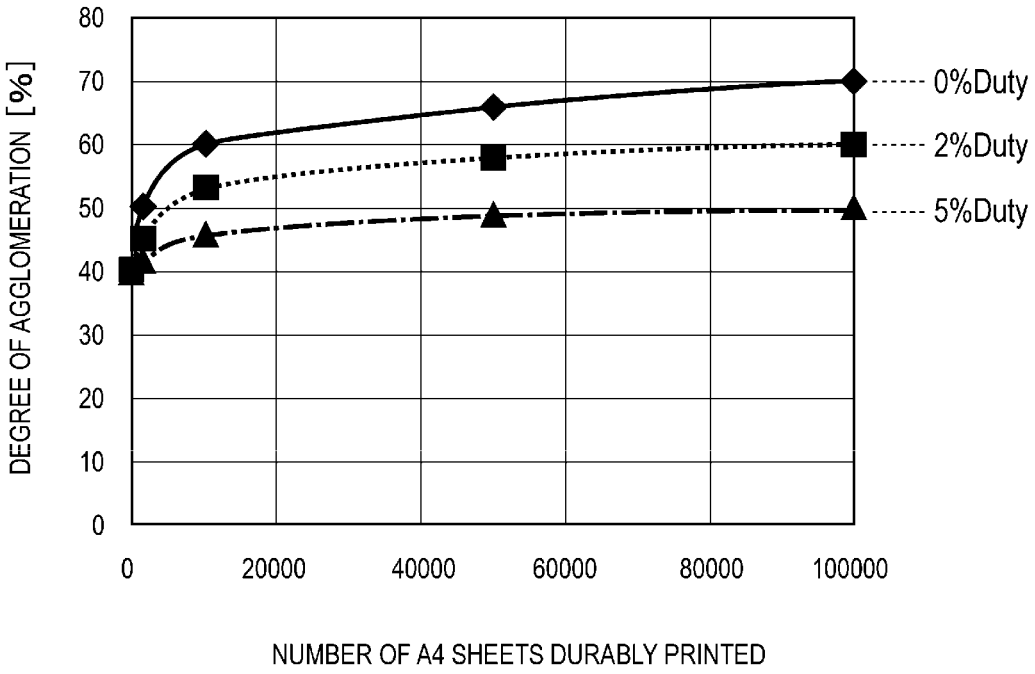
FIG. 4 is a graph showing changes in a degree of agglomeration of toner by a number of sheets durably printed.

FIG. 4 is a diagram showing changes in a degree of toner agglomeration by a number of durably printed sheets. Durable printing mode is set such that in the high temperature and high humidity environment at (30° C., 80% RH), an image with image duty (image ratio) 1%, 2% and 5% is continuously formed on a paper of A4-size.

As shown in FIG. 4, there is a tendency that as the number of sheets durably printed increases, a degree of toner agglomeration increases. Further, as an image duty is lower, a degree of toner agglomeration increases.

In the high-temperature and high-humidity environment at (30° C., 80% RH) explained above, an image with the image duty of 1% is formed on 100000 copies in A4 size. At that time, whether there are agglomeration marks or missing parts of image in a stripe shape is confirmed. In addition, a degree of the agglomeration is measured at that time.

The results of the studies with a variety of conditions are summarized in FIG. 5. FIG. 5 is a table showing examination results and various conditions of embodying examples of the first embodiment, comparative examples and conventional examples. However, the frequency of vibrating the vibrating member 50 is set to once in every 1000 sheets in common.

Figure 6:
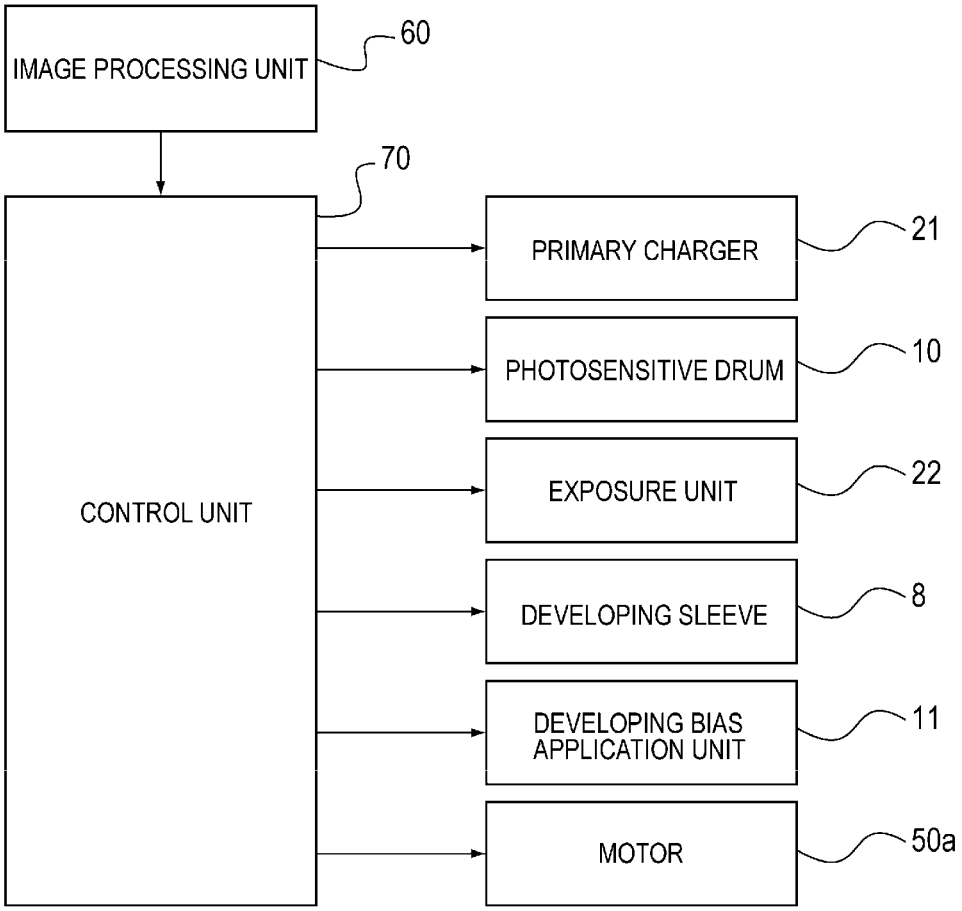
FIG. 6 is a control block diagram of the first embodiment.

FIG. 6 is a control block diagram of the first embodiment. The information obtained by the image processing unit 60 is transmitted to the control unit 70 which comprises a CPU for executing control to form an image, a RAM and a ROM. Then, the control unit 70 performs driving control of the primary charger 21, the photosensitive drum 10, the exposure unit 22, the developing sleeve 8, the developing bias application unit 11, the motor 50*a* of the vibration member 50 and the like.

Figure 7:
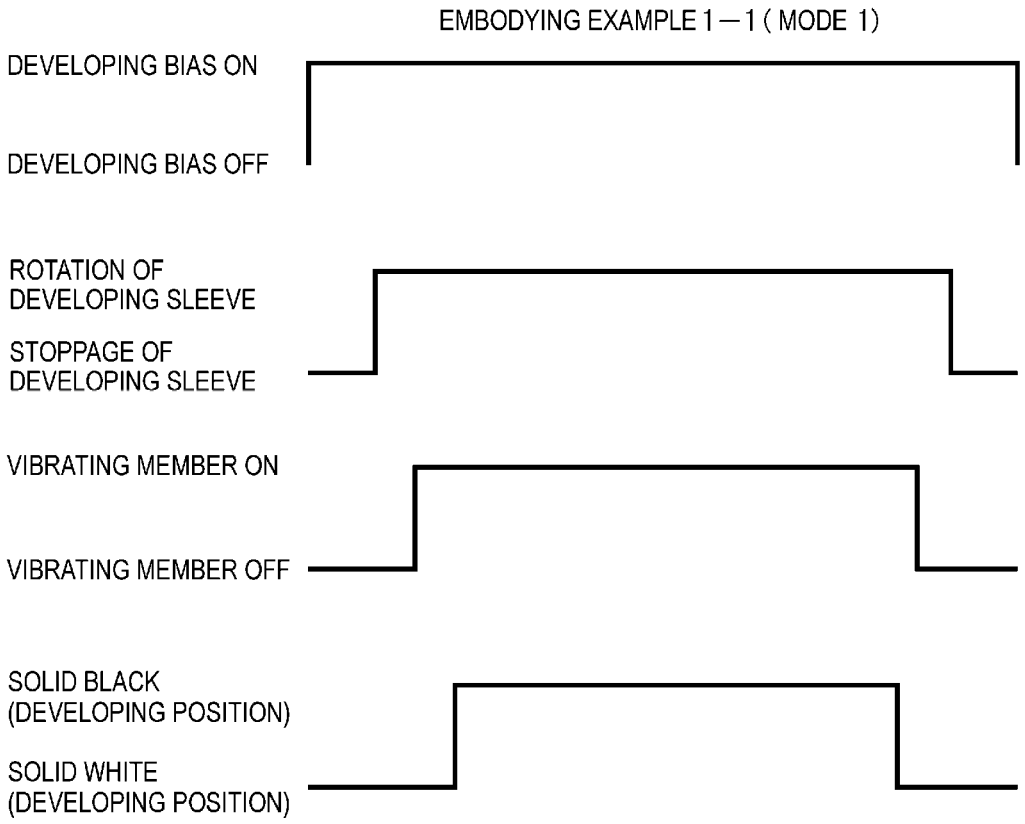
FIG. 7 is a timing chart of the embodying example 1-1 of the first embodiment.

FIG. 7 is a timing chart of the embodying example 1-1 of the first embodiment. In the embodying example 1-1, the timing for vibrating the vibrating member 50 is set as shown in FIG. 7 (mode 1).

As shown in FIG. 7, the control unit 70 rotates the developing sleeve 8 after the control unit 70 applies a developing bias to the developing sleeve 8 during the non-image formation period. After that, the control unit 70 starts the vibration of the vibrating member 50 and thereafter the control unit 70 issues a toner consumption signal for forming a solid black image to the photosensitive drum 10.

In the description below, solid black is a state in which toner is supplied to the entire image area and solid white is a state in which toner is not at all supplied to the entire image area.

In the embodying example 1-1, the potential (drum potential) of the photosensitive drum 10 is set to −800V (at solid white mode) and the DC component of the developing bias applied to the developing sleeve 8 is set to −650V and the drum potential during the electric field for development is set to 450V (at solid black mode). In addition, the vibration time of the vibration member 50 is set to is and the time required for discharging the solid black image equivalent to the amount of toner in one sheet of A4 is set to 0.7 s.

By vibrating the vibrating member 50 while toner is transferred to the photosensitive drum 10 under the condition described above, the toner agglomeration layer near the regulating blade 9 can be eliminated. In addition, the toner agglomerates that come out from between the regulating blade 9 and the developing sleeve 8 are discharged to the photosensitive drum 10. A toner consumption mode in which the above discharge is performed while the regulating blade 9 is vibrated by the vibrating member 50 is called vibration discharge sequence.

By performing the vibration discharge sequence under the above conditions, images of 100000 sheets were formed. Thereafter, a full halftone image was formed and whether there exist agglomeration marks or images with a stripe shape of low density was confirmed.

In embodying example 1-1, slight white streaks occurred, but it was possible to prevent agglomeration marks and images with a stripe shape of low density by performing the discharging during the vibration of the vibration member 50.

Under the conditions of embodying examples 1-1, the toner coming out of the agglomeration toner layer is developed on the photosensitive drum 10 without returning to the developing container 2. As a result, a degree of agglomeration of the developer remaining in the developing container 2 is improved. For this reason, the effect of preventing agglomeration marks and images with a stripe shape of low density was confirmed.

In the condition of embodying example 1-1, there is no problem in practice, but the slight white stripe is sometimes generated. As a factor of this phenomenon, it is considered that the timing of vibration of the vibrating member 50 has not been optimized. That is, it takes time T from the moment when the vibrating member 50 is vibrated until the toner agglomerates reach the developing area. In this case, it is because a part of the toner agglomerates that come out by the vibration is not developed and is collected in the developing container 2.

For comparison, a case of absence of vibration of the vibrating member 50 was investigated. In the comparative example, agglomeration marks and images with a stripe shape of low density occurred. Further, in the comparative example, developer deterioration progressed and a toner agglomeration layer accumulated near the regulating blade 9, thereby agglomerates marks and images with a stripe shape of low density occurred.

As a conventional example, a case was investigated where only the vibration of the vibrating member 50 is implemented and discharging operation is not performed during the vibration period. In the conventional example, images with a stripe shape of low density did not occur but toner agglomerates and white streaks which are minor types of images with a stripe shape of low density occurred. Although, there is the effect of eliminating the toner agglomeration layer near the regulating blade, there is no effect of improving deterioration of the developer because the toner in the toner agglomeration layer which comes out by the vibration returns to the developing container 2. Therefore, toner agglomeration marks and white streaks occurred. As explained above, the configuration of the conventional example and the comparative example, it was not possible to prevent image defects.

Figure 8:
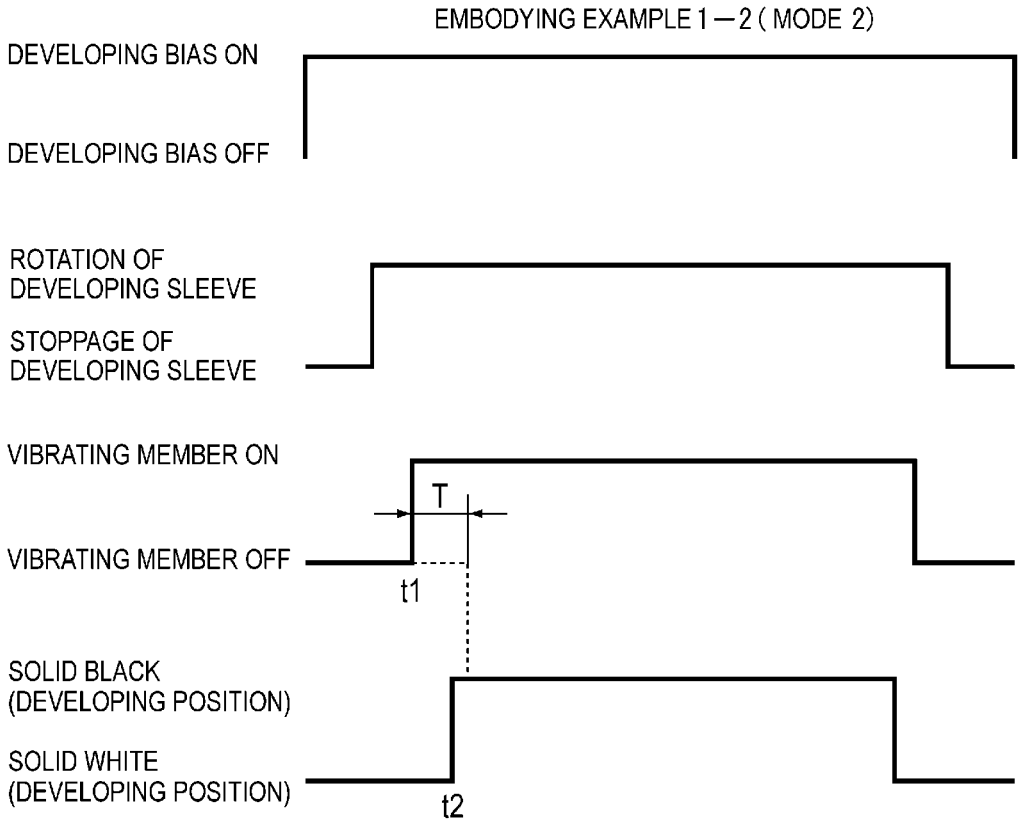
FIG. 8 is a timing chart of the embodying example 1-2 of the first embodiment.

FIG. 8 is a timing chart of the embodying example 1-2 of the first embodiment. Timing of the starting of vibration of vibrating member 50 is shown in FIG. 8 (mode 2).

In the embodying example 1-2, a limitation is provided with the timing of vibration start and the timing when the electric field of solid black reaches the developing region.

Specifically, as shown in FIG. 8, given the time t1 at which the vibration of the vibrating member 50 is started, the time t2 at which a leading edge (solid black image tip) of a toner consumption signal reaches the developing region and the time period T during which the developer moves from the regulating blade 9 to the developing region, the time t1, the time t2 and time period T satisfy $t2<t1+T$. That is, the operation is controlled such that after vibration of the vibrating member 50 is started and before the developer reaches the developing region, the electric field of the solid black reaches the developing region. Thereby, when the vibrating member 50 starts to vibrate, the toner agglomerates which have passed through the regulating blade 9 can be developed on the photosensitive drum 10.

As a result of using the mode of the embodying example 1-2, it was possible to prevent image defects for a long period of time without producing toner agglomerates, images with a stripe shape of low density and white streaks. It is considered that this is because an increase in a degree of agglomeration of the developer in the developing container is suppressed due to fact that developing on the photosensitive drum 10 is assured by eliminating the toner agglomeration layer with the vibration of the vibration member.

Figure 9:
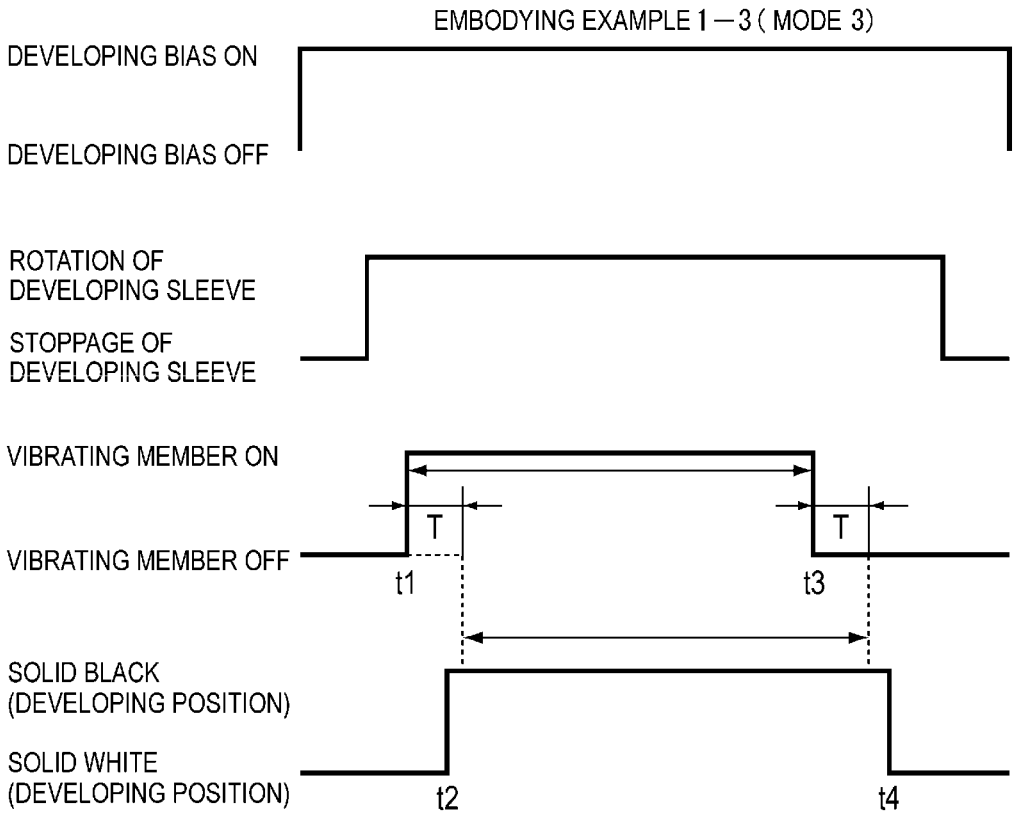
FIG. 9 is a timing chart of the embodying example 1-3 of the first embodiment.

FIG. 9 is a timing chart of the embodying example 1-3 of the first embodiment. In the embodying example 1-3, a limitation is provided for the timing of vibration end and the timing of the end of the electric field of solid black (mode 3).

In the embodying example 1-3, as shown in FIG. 9, given the time t3 at which the vibration of the vibrating member is stopped, the time t4 at which the toner consumption signal finishes to pass through the developing region, the times t1 to t4 and the time period T satisfy $t2<t1+T<t3+T<t4$.

That is, in a case of forming a solid black image, vibration of the vibrating member 50 is started and thereafter the tip of solid black image formed by applying a solid black potential on the photosensitive drum 10 reaches the developing region and thereafter the developer in the developing sleeve 8 reaches the developing region.

Further, in a case of forming a solid white image, after the position on the developing sleeve 8 which passes through the position of the regulating blade 9 has reached the developing region, the tip of the solid white image (rear end of the solid black image) on the photosensitive drum 10 reaches the developing region. A solid white potential on the photosensitive drum 10 is formed by a signal (toner consumption release signal) for releasing the solid black potential issued by the control unit 70.

As a result of using the mode of the embodying example 1-3, it was possible to prevent image defects for a long period of time without producing toner agglomerates, images with a stripe shape of low density and white streaks, similarly to the embodying example 1-2

[Second Embodiment]

Next, the second embodiment will be explained. The same reference numerals are attached to elements having functions or configurations identical with or corresponding to the foregoing embodiment and detailed explanation thereof is omitted and only the points which are characteristic to this embodiment will be explained below.

The results of the studies with various conditions according to the second embodiment are summarized in FIG. 10. FIG. 10 is a table showing examination results and various conditions of embodying examples of the second embodiment. This table contains the frequencies in which the vibration member 50 is repeatedly vibrated.

In the embodying examples 1 (the embodying example 1-1 to embodying example 1-3) of the first embodiment, the discharging operation is performed in conjunction with the vibration mode performed regularly. In the embodying examples 1, a frequency in which the vibrating member 50 is repeatedly vibrated is fixed to every 1000 sheets of print.

In the second embodiment, a frequency of vibration of the vibrating member 50 is set depending on the images duty and the number of printed sheets as shown in the embodying examples 2 to 5.

In the embodying example 2, as in the first embodiment, the vibration of the vibrating member 50 is carried out in conjunction with the discharging operation. However, a frequency in which the vibrating member 50 is repeatedly vibrated is not every constant number of printed sheets but is changed according to image duty.

By doing so, it is possible to discharge the toner agglomerates during the conventional discharge operation, which makes it more efficient. Further, the configuration is capable of suppressing as much as possible an amount of toner consumed during the discharging operation, which does not contribute to image formation. Details will be explained below.

As shown in FIG. 10, in the embodying example 2, when the image formation of low image duty (low image ratio) continues, a frequency of vibration discharging sequence is made higher as an image duty is lower.

Figure 11:
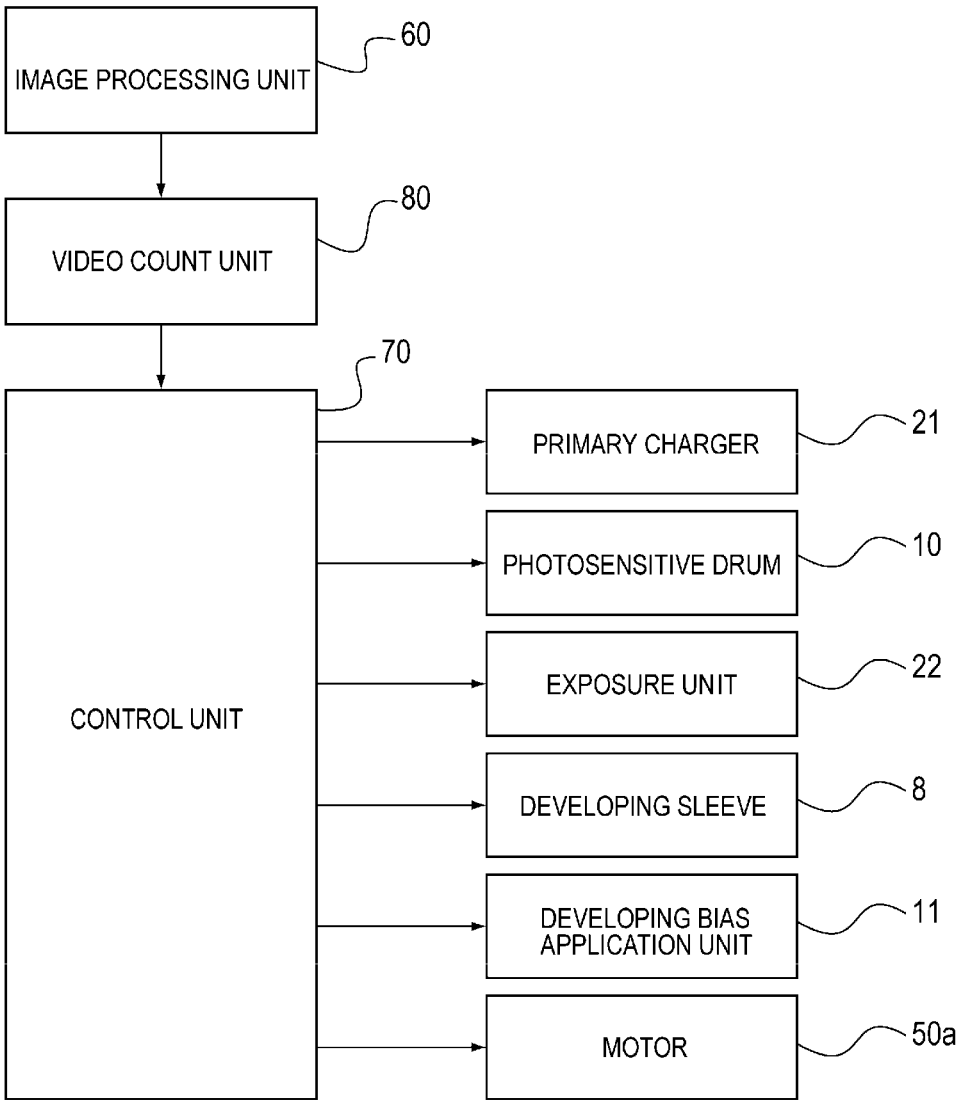
FIG. 11 is a control block diagram of the second embodiment.

FIG. 11 is a control block diagram of the second embodiment. The information obtained by the image processing unit 60 is transmitted to the control unit 70 via the video count unit 80. Then, the control unit 70 performs control of the primary charger 21, the photosensitive drum 10, the exposure unit 22, the developing sleeve 8, the developing bias applying unit 11, the drive motor 50*a* of the vibration member 50 and the like.

As described above, in embodying example 2, when the image formation of an image of a low duty continues, a frequency of vibration of the vibrating member 50 is increased. In addition, since the vibration of the vibration member 50 is carried out in conjunction with the discharging operation, the lower the image duty is, the higher a frequency of the vibration discharge sequence becomes. Specifically, the vibration discharge sequence is performed every 1000 sheets at less than 1% duty, every 4000 sheets at the duty of 1%~2%, and every 10,000 sheets at the duty of 2%~5%. The thresholds are not limited to these numbers of sheets and can be changed accordingly.

In the embodying example 1, the vibration discharge sequence is performed at a constant frequency for any image duty. In contrast, in the embodying example 2, the vibration discharge sequence is performed at a common timing of the conventional discharging operation of deteriorated toner. Therefore, when a large number of images with high image duty are printed, it is possible to suppress toner consumption of the discharging operation. Also, in the embodying example 2, image defects can be prevented as in the first embodiment.

In the embodying example 3, as shown in FIG. 10, vibration of the vibrating member 50 is performed only during the low duty discharging operation which will be described blow. Therefore, vibration of the vibrating member 50 and the discharging operation are performed at the same time. The low duty discharging operation is defined as an operation in which a constant amount of toner is discharged to the photosensitive drum 10 to prevent toner from deteriorating when low duty images continue. In the embodying example 3, the threshold of low duty is set to 2%.

When vibration of the vibrating member 50 is performed during the low duty discharging operation, degradation of images can be prevented without decreasing productivity as compared with vibration of the vibrating member 50 performed separately from the low duty discharging operation.

Figure 12:
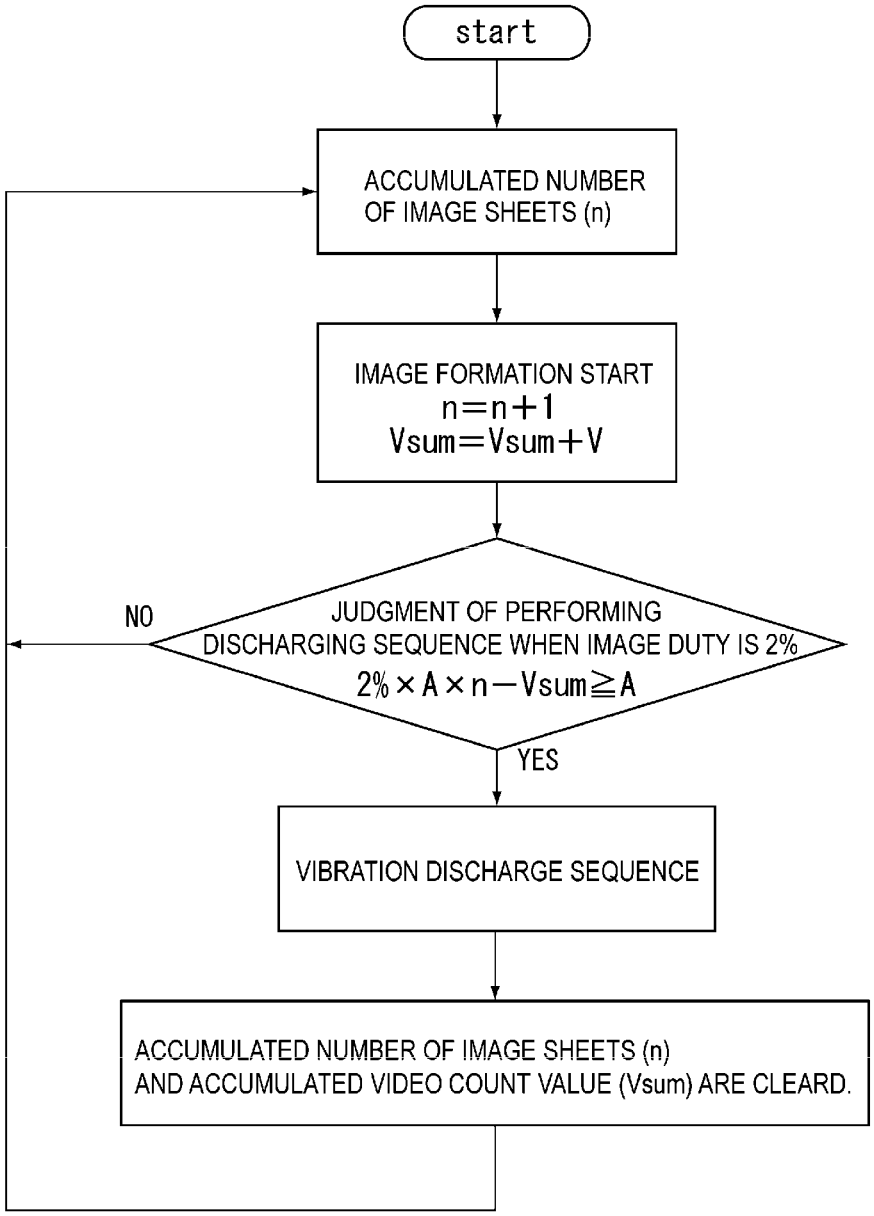
FIG. 12 is a flowchart of a low duty vibration discharge sequence.

Next, the low duty vibration discharge sequence of the embodying example 3 will be explained. FIG. 12 is a flow chart of the low duty vibration discharge sequence. In FIG. 12, a case is illustrated when a threshold of image duty of low duty discharging is set to 2%.

In FIG. 12, V denotes a video count value, Vsum denotes an accumulated video count value, and A denotes a video count value equivalent to 100% duty per a sheet of the size A4.

When the image duty threshold of low duty discharging is set to 2%, if the image duty is equal to or less than 2%, (video count value of image duty 2%)−(accumlated value of the video count value of real images) is calculated. Then, if the calculated value reaches a value corresponding to 100% duty of A4 size, the vibration discharge sequence is performed.

In the embodying example 4, as shown in FIG. 10, vibration of the vibrating member 50 is performed during the low duty discharging operation which will be described later. In addition to this, vibration of the vibrating member 50 is performed when the printing of low image ratio reaches a predetermined number of sheets. Also, in this case, vibration of the vibrating member 50 is performed during the discharging operation.

The embodying example 4 has a configuration in combination of the embodying example 2 and the embodying example 3, and a vibration mode is performed during discharging operation. In the embodying example 4, the threshold of the low duty image is set to 5%.

In the embodying example 4, the vibration discharge sequence is repeatedly performed at a constant repeat frequency during a period other than the low duty discharging period if the frequency of vibration is not enough when the vibrating member 50 is vibrated only during the low duty discharging period.

As in the embodying example 4, when the vibration sequence is performed in which the vibrating member 50 is vibrated repeatedly at a constant frequency during a period other than the period in which the vibrating member 50 is vibrated during the low duty discharging operation, the configuration can be made such that toner discharging operation is not performed during the vibration sequence performed repeatedly at a constant frequency. In other words, discharging operation may be performed only during low duty discharging operation.

This is because most parts of toner agglomerates are discharged outside of the developing device by vibrating the vibrating member 50 during the low duty discharging operation and it causes no problem. With this configuration, it is also possible to obtain the effect of suppressing toner consumption due to unnecessary toner discharging.

In the embodying example 5, as shown in FIG. 10, the vibration of the vibrating member 50 is performed every 1,000 printed sheets and when the printing of low image ratio reaches a predetermined number of sheets. In the embodying example 5, the discharging operation is not performed every 1,000 printed sheets and only the vibration of the vibrating member 50 is performed at that timing. That is, when the printing of images with low image ratios reaches a predetermined number of sheets, the discharging operation is performed in conjunction with the vibration of the vibration member 50.

As in the above explained embodying examples, by vibrating of the vibrating member 50 in conjunction with the discharging operation as appropriate, the discharging of toner agglomerates can be assured, while unnecessary toner discharging can be suppressed.

In addition, a button may be provided for performing the vibration discharge sequence when a service person or a user finds a defective image.

[Third Embodiment]

Next, the third embodiment will be explained. The same reference numerals are attached to elements having functions or configurations identical with or corresponding to the foregoing embodiments and detailed explanation thereof is omitted and only the points which are characteristic to this embodiment will be explained below.

Figure 13:
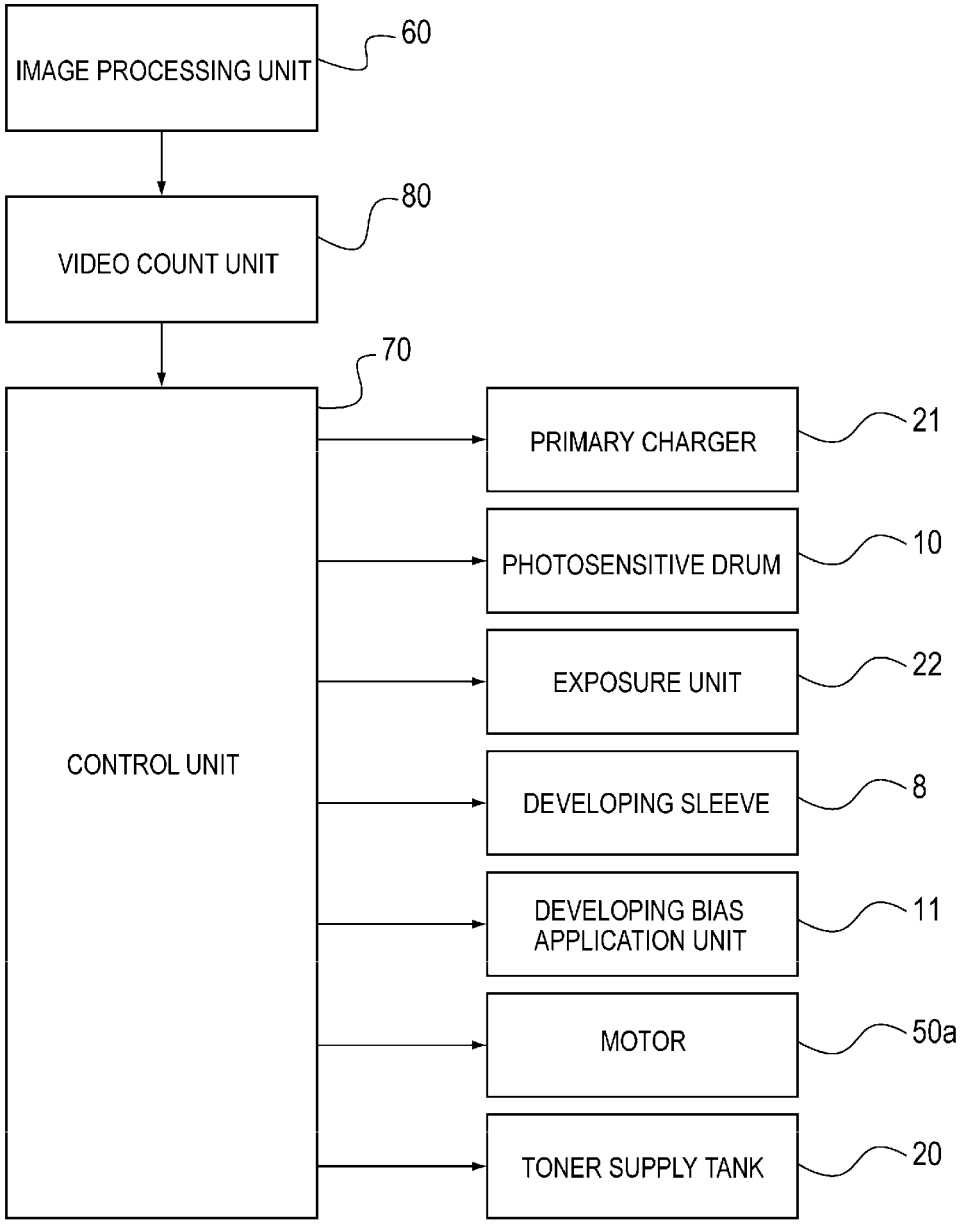
FIG. 13 is a control block diagram of the third embodiment.

FIG. 13 is a control block diagram of the third embodiment. The information obtained by the image processing unit 60 is transmitted to the control unit 70 via the video count unit 80. Then, the control unit 70 performs control of the primary charger 21, the photosensitive drum 10, the exposure unit 22, the developing sleeve 8, the developing bias applying unit 11, the drive motor 50*a* of the vibration member 50, the toner supply tank 20 and the like.

In this embodiment, a supplying operation is performed during the vibration discharge sequence. When the supplying operation is performed, fresh toner is supplied to the developing container 2. Then, the supplied developer is circulated by the first conveying screw 5 and the second conveying screw 6 and it is conveyed to the back of the regulating blade 9 during developing operation.

The developer of fresh toner which has just been supplied from the toner supply tank 20 to developing device 2 has high fluidity. On the other hand, the developer forming the immobile layer which is originally present behind the regulating blade 9 is degraded and has low fluidity. Therefore, there is difference in the fluidity between the supplied fresh toner and the developer in the immobile layer.

When the developer with high fluidity passes through vicinity of the immobile layer of the back of the regulating blade 9, the immobile layer is broken. Thereby, the ratio that the toner agglomerates come out from the immobile layer becomes high.

By utilizing this effect, the supplying operation with the toner supply tank 20 is performed after start of rotation of the developing sleeve 8. The control is set such that the supplied toner reaches the back of the regulating blade 9 after the vibrating member 50 is started to vibrate by the time when the vibration of the vibrating member 50 is stopped. An amount of toner consumed during discharging operation is previously calculated from the discharging amount and supply amount is determined accordingly.

Figure 14:
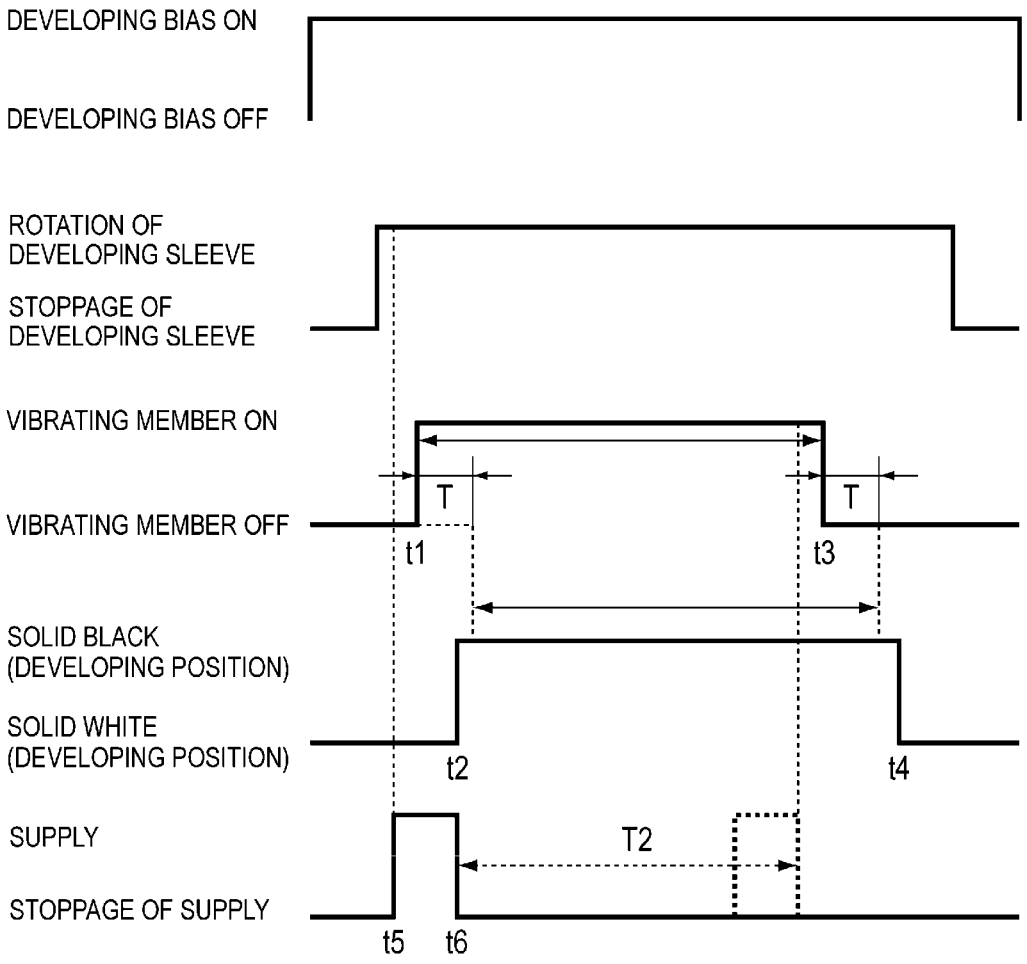
FIG. 14 is a timing chart of the third embodiment.

FIG. 14 is a timing chart of the third embodiment.

As shown in FIG. 14, in this embodiment, $t2<t1+T<t3+T<t4$ and $t5<t6+T2<t3$ are satisfied.

In these formulas, the supply start time t5 by the toner supply tank 20, the supply end time t6 by the toner supply tank 20, the time T2 during which the supplied toner reaches the back of the regulating blade 9 are given. Also, as mentioned above, in these formulas, the time t1 at which the vibration of the vibrating member 50 is started, the time t2 at which the front tip of electrostatic latent image for toner discharging reaches the developing region, the time period T during which the developer moves from the regulating blade 9 to the developing region, the time t3 at which the vibration of the vibrating member is stopped and the time t4 at which the rear tip of electrostatic latent image for toner discharging finishes to pass through the developing region are given.

By controlling the developing sleeve 8, the photosensitive drum 10, the vibration member 50, the toner supply tank 20 and the like as explained above, toner agglomerates can be broken and conveyed to the photosensitive drum 10 more efficiently. Thereby, image defects can be prevented.

With the above configuration, the defect is suppressed that the degraded toner agglomerates having passed through the regulating member are collected by the developing device when executing the mode of vibrating toner agglomerates by driving a developer bearing member during non-image formation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-240583, filed Nov. 21, 2013, and No. 2013-256862, filed Dec. 12, 2013, which are hereby incorporated by reference herein in their entirety.

What is claimed is:

1. An image forming apparatus, comprising:

an image bearing member on which an electrostatic latent image is formed;

a developing device which develops the electrostatic latent image at a developing position facing the image bearing member, the developing device including a developer bearing member which rotates while bearing developer containing toner and which supplies the image bearing member with the toner; a regulating member which regulates a layer thickness of the developer born by the developer bearing member; and a vibrating member which vibrates the regulating member when the vibrating member is driven; and a control unit that performs a mode of vibrating the regulating member while rotating the developer bearing member during a non-image forming period and of transferring from the developer bearing member to the image bearing member the toner which passes through the regulating member during vibration of the regulating member.

2. The image forming apparatus according to claim 1, wherein the control unit controls the image forming apparatus in the mode such that the transferring of the toner from the developer bearing member to the image bearing member is started before a position of the developer bearing member, which faces the regulating member when the vibration of the regulating member is started, reaches the developing position.

3. The image forming apparatus according to claim 1, wherein the control unit controls the image forming apparatus in the mode such that the transferring of the toner from the developer bearing member to the image bearing member is completed after a position of the developer bearing member, which faces the regulating member when the vibration of the regulating member is stopped, reaches the developing position.

4. The image forming apparatus according to claim 1, wherein the control unit controls the image forming apparatus such that a frequency of the transferring of the toner on the developer bearing member to the image bearing member is increased while vibrating the vibrating member when image formation with an image ratio lower than a predetermined image ratio continues during the non-image forming period.

5. The image forming apparatus according to claim 1, further comprising a toner supply device which supplies toner to the developing device, wherein the control unit controls supply timing of the toner supply device such that the toner supplied by the supply device reaches the regulating member during the vibration of the regulating member in the mode.

6. The image forming apparatus according to claim 5, wherein the control unit controls the image forming apparatus in the mode such that the toner supplied by the supply device is transferred to the image bearing member by passing through the regulating member while the regulating member is vibrated.

7. The image forming apparatus according to claim 1, wherein the control unit controls the image forming apparatus in the mode so as to transfer to the image bearing member the toner from a region on the developer bearing member passing through the regulating member when the vibration of the regulating member is started to a region on the developer bearing member passing through the regulating member when the vibration of the regulating member is stopped.

* * * * *